US006491026B1

(12) United States Patent
Andorfer

(10) Patent No.: US 6,491,026 B1
(45) Date of Patent: Dec. 10, 2002

(54) FUEL INJECTION DEVICE

(75) Inventor: Martin Andorfer, Münchingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/646,747

(22) PCT Filed: Oct. 28, 1999

(86) PCT No.: PCT/DE99/03450

§ 371 (c)(1),
(2), (4) Date: Nov. 17, 2000

(87) PCT Pub. No.: WO00/43668

PCT Pub. Date: Jul. 27, 2000

(30) Foreign Application Priority Data

Jan. 21, 1999 (DE) ..... 199 02 186

(51) Int. Cl.[7] ..... F02M 55/02
(52) U.S. Cl. ..... 123/470; 123/456
(58) Field of Search ..... 123/456, 470, 123/469, 468, 509, 467

(56) References Cited

U.S. PATENT DOCUMENTS

| | | | | |
|---|---|---|---|---|
| 4,395,988 A | | 8/1983 | Heinrich et al. | |
| 4,823,754 A | | 4/1989 | Minamoto et al. | |
| 4,950,171 A | * | 8/1990 | Muzslay | 439/76.1 |
| 4,991,557 A | * | 2/1991 | DeGrace et al. | 123/470 |
| 5,035,224 A | | 7/1991 | Hornby et al. | |
| 5,038,738 A | * | 8/1991 | Hafner et al. | 123/470 |
| 5,394,850 A | * | 3/1995 | Murphy et al. | 123/470 |
| 5,616,037 A | | 4/1997 | Lorraine | |
| 5,724,946 A | | 3/1998 | Franchitto | |
| 6,102,007 A | * | 8/2000 | Furst | 123/469 |
| 6,148,797 A | * | 11/2000 | Gmelin | 123/456 |
| 6,199,538 B1 | * | 3/2001 | Aota et al. | 123/470 |

FOREIGN PATENT DOCUMENTS

| | | |
|---|---|---|
| DE | 34 28 597 | 2/1986 |
| DE | 39 04 479 | 8/1990 |
| DE | 39 18 410 | 12/1990 |
| DE | 39 19 231 | 12/1990 |
| DE | 40 17 875 | 12/1991 |
| DE | 44 13 914 | 10/1995 |
| DE | 195 46 441 | 6/1997 |

* cited by examiner

*Primary Examiner*—Carl S. Miller
(74) *Attorney, Agent, or Firm*—Kenyon & Kenyon

(57) ABSTRACT

A fuel injection device for an internal combustion engine has a fuel distributor, which has a plurality of connecting pieces for accommodating, in a liquid-tight manner, fuel injectors. First connecting elements are provided on each connecting piece, and second connecting elements are provided on each fuel injector to achieve a secure connection. The first connecting elements on the connecting piece protrude radially inward. The second connecting elements on the fuel injector is designed as a groove-like depression. The connecting piece has a slot-like interruption in its end section having the first connecting elements.

13 Claims, 2 Drawing Sheets

FUEL INJECTION DEVICE

FIELD OF THE INVENTION

The present invention relates to a fuel injection device according to the definition of the species of the main claim.

BACKGROUND OF THE INVENTION

Fuel injection devices having a fuel distributor on which a plurality of connection pieces are provided for mounting fuel injectors are known from a series of documents. In general, additional connecting elements are used for secure and possibly rotation-free installation of the fuel injectors in the connection pieces; these connecting elements function as clamps or clasps in the connection area. Such connecting elements include a U-shaped elastic clamp described in German Published Patent Application No. 34 28 597, a C-shaped plastic clip described in German Published Patent Application No. 39 04 479, a U-shaped elastic clamp described in German Published Patent Application No. 39 18 410, another U-shaped elastic clamp described in German Published Patent Application No. 40 17 875, a two-legged locking plastic clip described in German Published Patent Application No. 44 13 914, a U-shaped bracket described in U.S. Pat. No. 4,823,754, and a U-shaped elastic clamp described in U.S. Pat. No. 5,035,224. All the above-mentioned fuel injection devices are characterized by the fact that the connecting element engages in a depression of the fuel injector and the connecting element engages a catching element extending radially outward in some form on the connection piece of the fuel distributor.

Furthermore, fuel injection devices in which no additional connecting elements are used in the connection area of the fuel injector and the connecting piece of the fuel distributor are known, with either catch springs (German Patent No. 39 19 231) or catch lugs (German Published Patent Application No. 195 46 441) being provided on the peripheries of the fuel injectors for such fuel injection devices. The snap springs engage a lock collar extending radially outward on the connecting piece of the fuel distributor, while the catch lugs engage in the window-like recesses of the extended connecting piece.

SUMMARY OF THE INVENTION

The fuel injection device according to present invention has the advantage that it allows the fuel injectors to be firmly and securely connected in the connecting pieces of the fuel distributors. No additional clamp or latch-type connecting elements are needed to fasten the fuel injectors. In this manner, very simple assembly and disassembly are guaranteed.

In a particularly advantageous manner, the fuel injector can be prevented from rotating using very simple measures in designing the corresponding connecting elements of the connecting piece and the fuel injector. In addition, the desired unique position of the installed injector can be achieved in a very simple manner. For this purpose, only two connecting elements of the connecting piece is designed to have different sizes, for example, which then engage in two corresponding connecting elements of the fuel injector having different sizes.

The fuel injection device is advantageously designed so that the connecting piece presses its connecting elements radially into the corresponding recessed connecting elements under radial stress due to interruptions in the end section of the connecting piece.

BRIEF DESCRIPTION OF THE DRAWINGS

Embodiments of the present invention are illustrated in the drawing in a simplified manner and explained in detail in the following description.

DETAILED DESCRIPTION

Figure 1:
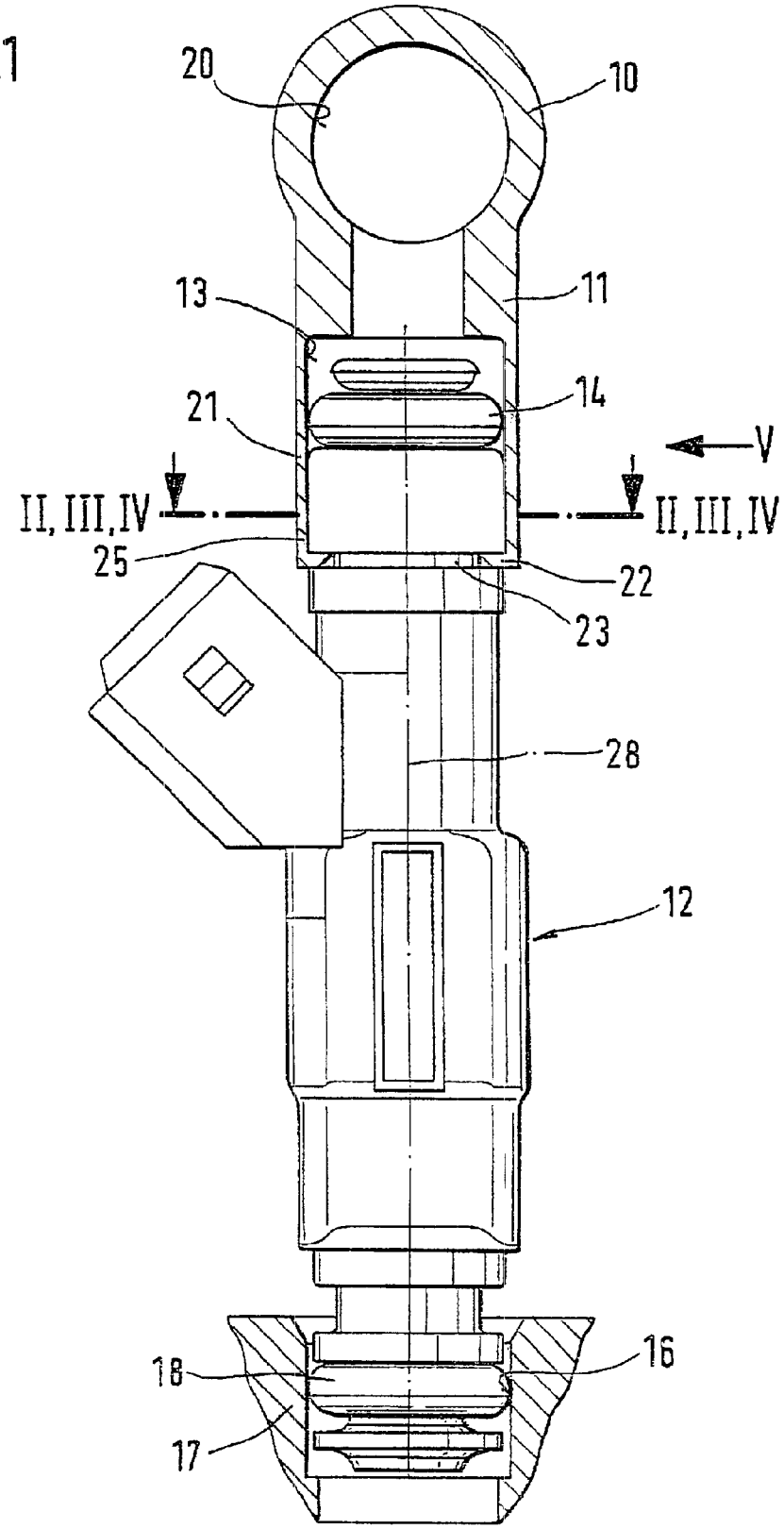
FIG. 1 shows a section of a fuel injection device.

The fuel injection device for internal combustion engines partially illustrated in FIG. 1 has a fuel distributor 10 made of plastic or aluminum, which carries a plurality of connecting pieces 11. The same number of fuel injectors 12 as connecting pieces 11 are provided, fuel injectors 12 protruding with their inlet-side upper ends into fuel supply openings 13 of connecting pieces 11. Fuel injectors 12 are therefore designed as top feed injectors.

The number of connecting pieces 11 and fuel injectors 12 depends on the number of cylinders of the internal combustion engine to be supplied with fuel. For example, for a four-cylinder internal combustion engine, four fuel injectors 12 are provided, each installed in a fuel-tight manner in one of four connecting pieces 11 of fuel distributor 10 with the help of a top gasket 14.

Fuel injector 12 protrudes with its injection-side end into a mounting hole 16 of a cylinder head 17 (direct injection) or of a mounting connection piece 17 formed on an intake manifold (intake manifold injection). Fuel-tight installation of fuel injector 12 is guaranteed by a bottom gasket 18.

Fuel injectors 12 used in the fuel injection device according to the present invention are, for example, electromagnetically actuated injectors or injectors actuated by piezoelectric actuators or magnetostrictive actuators.

Fuel supply opening 13 of connecting piece 11 has a stepped design, for example, supply opening 13 having a smaller diameter near a distributor opening 20 of fuel distributor 10 than in an area 21 of connecting piece 11 surrounding fuel injector 12. The outer diameter of connecting piece 11 is constant over its entire length. In order to secure fuel injector 12 in fuel supply opening 13 of connecting piece 11, fuel injector 12 and connecting piece 11 are provided with connecting elements 22, 23 corresponding to one another.

At least one hook-shaped connecting elements 22 is formed at the end of connecting piece 11 remote from distributor opening 20. This at least one connecting elements 22 engages into a corresponding connecting elements 23 representing a depression on the outer periphery of fuel injector 12. This depressed connecting elements 23 is a peripheral groove in the plastic coating of fuel injector 12, for example. Contrary to all known devices, connecting elements 22 of the fuel injection device according to the present invention formed on connecting piece 11 protrude radially inward into fuel supply opening 13.

Figure 2:
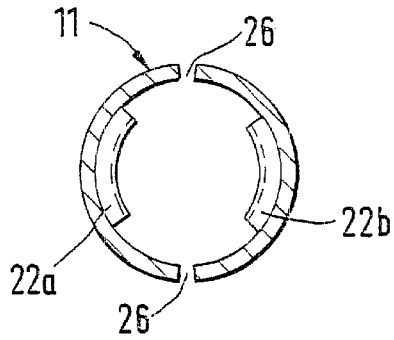
FIG. 2 shows a first embodiment of a connecting piece as a section along line II—II in FIG. 1.
Figure 3:
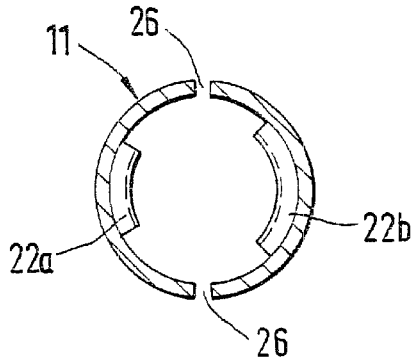
FIG. 3 shows a second embodiment of a connecting piece as a section along line III—III in FIG. 1.
Figure 4:
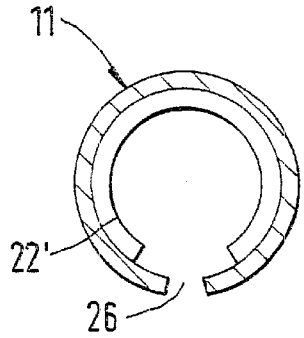
FIG. 4 shows a third embodiment of a connecting piece as a section along line IV—IV in FIG. 1.

FIG. 2 shows a first embodiment of a connecting piece 11 as a section along line II—II in FIG. 1, while FIG. 3 shows a second and FIG. 4 shows a third embodiment of a connecting piece 11 as a section along line III—III and line IV—IV, respectively, in FIG. 1. The sectional drawings are only sectioned connecting pieces 11 without fuel injectors 12 that can be inserted into them.

FIGS. 2 and 3 show two examples of a two-part connecting elements 22*a,* 22*b*. Two connecting elements 22*a,* 22*b* diametrically opposite one another having hook-shaped cross-sections and extending approximately 80° (FIG. 2) in the peripheral direction are provided. Connecting elements 22*a,* 22*b* may, however, also extend in an angular range of 20° to 120°. When using such a connecting piece 11, the corresponding connecting elements 23 of fuel injector 12 can also be made of two parts. Thus, connecting elements 22*a,* 22*b* may engage into two groove-like or slot-like, however not peripheral, connecting elements 23 on fuel injector 12. This design effectively prevents fuel injector 12 from rotating.

The two connecting elements 22*a,* 22*b* do not need to have the same dimensions. If connecting elements 22*a,* 22*b* and the corresponding connecting elements 23 have different dimensions, as shown in FIG. 3, a unique installed position of fuel injector 12 in connecting piece 11 is obtained as is often desired. In this manner it is ensured, without any additional design, that the desired installed position is exactly implemented.

Connecting elements 22 may also have more than two parts; three to eight connecting elements 22*a,* 22*b* may also be used. On the other hand, connecting elements 22' can also be made of a single piece, as FIG. 4 shows. Connecting elements 22' does not extend 360° in the peripheral direction, but instead, for example, over an angular range of 240° to 320°.

As connecting elements 22, 22' are interrupted at least at one point, i.e., may not extend over 360°,in order to install fuel injector 12 in connecting piece 11, the latter is not be designed to extend over 360° at least in the area of connecting elements 22, 22'. Instead, connecting piece 11 in its end section 25 facing away from fuel distributor 10 and facing connecting elements 22, 22' must be provided with at least one interruption 26 which allows connecting piece 11 to slightly expand radially.

FIGS. 2 and 3 show connecting pieces 11 having two interruptions 26 exactly diametrically opposite one another. In this manner, two segments of end section 25 are obtained having connecting elements 22 arranged in the middle. End section 25 may, however, be also designed with three to eight interruptions 26, resulting in three to eight segments of end section 25 having in turn three to eight connecting elements 22. In contrast, FIG. 4 shows an example of connecting elements 11 having only one interruption 26.

Figure 5:
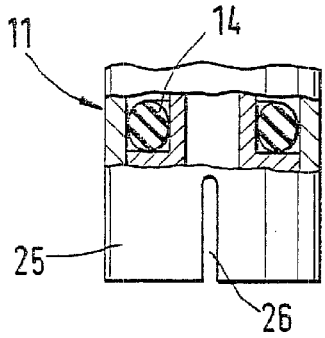
FIG. 5 shows a schematic and partially sectioned side view of the connecting piece.

Interruptions 26 have a slot-shaped design, for example, the axial length of interruptions 26 being limited. Ideally, interruptions 26 have the length only sufficient so that they begin, when fuel injector 12 is mounted in connecting piece 11, downstream from upper gasket 14 and extend up to connecting elements 22, 22'. Interruptions 26 are therefore applied only directly in lower end section 25 of connecting piece 11, thus guaranteeing complete sealing by upper gasket 14. FIG. 5 shows this embodiment through a schematic and partially sectioned side view of connecting piece 11. Internal fuel supply opening 13 in area 21, i.e., upper gasket 14, has diameter from which the at least one connecting elements 22, 22' protrudes further inward in the direction toward a longitudinal injector axis 28, so that connecting elements 22, 22' engage indirectly in gasket 14 from below over a certain axial distance.

What is claimed is:

1. A fuel injection device for an internal combustion engine, comprising:

a fuel distributor including a plurality of connecting pieces for accommodating, in a liquid-tight manner, a plurality of fuel injectors;

at least one first connecting element arranged on each one of the plurality of connecting pieces, wherein:

on at least one of the plurality of connecting pieces, the at least one first connecting element protrudes radially inward, and the plurality of connecting pieces each include at least one interruption in an end section that includes the at least one first connecting element; and at least one second connecting element arranged on each one of the plurality of fuel injectors, the at least one first connecting element and the at least one second connecting element corresponding to one another to achieve a secure connection, wherein:

on at least one of the plurality of fuel injectors, the at least one second connecting element is shaped as a depression.

2. The fuel injection device according to claim 1, wherein:

the at least one first connecting element has a shape of a catch hook.

3. The fuel injection device according to claim 1, wherein:

the at least one first connecting element includes a first part and a second part.

4. The fuel injection device according to claim 3, wherein:

the first part and the second part extend in a peripheral direction over an angular range of between 20° and 120°.

5. The fuel injection device according to claim 3, wherein:

the first part and the second part have one of the same peripheral dimension and different peripheral dimensions.

6. The fuel injection device according to claim 1, wherein:

three to eight of the at least one first connecting element are formed on at least one of the plurality of connecting pieces.

7. The fuel injection device according to claim 1, wherein:

only one of the at least one first connecting element, extending over an angular range of between 240° and 320° in a peripheral direction, is provided on at least one of the plurality of connecting pieces.

8. The fuel injection device according to claim 1, wherein:

the at least one interruption includes a number of interruptions in at least one of the plurality of connecting pieces that is equal to a number of the at least one first connecting element on the plurality of connecting pieces.

9. The fuel injection device according to claim 1, wherein:

the at least one interruption includes a slot-like design.

10. The fuel injection device according to claim 1, wherein:

each fuel injector protrudes with an inlet end thereof into an internal fuel supply opening of a corresponding one of each of the plurality of connecting pieces, each fuel injector includes an upper gasket used for sealing the internal fuel supply opening against the corresponding one of each of the plurality of connecting pieces, and the at least one interruption only runs downstream from the upper gasket.

11. The fuel injection device according to claim 1, wherein:

each fuel injector protrudes with an inlet end thereof into an internal fuel supply opening of a corresponding one of each of the plurality of connecting pieces, each fuel injector includes an upper gasket used for sealing the internal fuel supply opening against the corresponding one of each of the plurality of connecting pieces, and the internal fuel supply opening and the upper gasket have a diameter from which the at least one first connecting element protrudes further inward in a direction of a longitudinal injector axis.

12. The fuel injection device according to claim 1, wherein:

the at least one second connecting element has a shape of a peripheral groove.

13. The fuel injection device according to claim 1, wherein:

a number of the at least one first connecting element on the plurality of connecting pieces is equal to a number of the at least one second connecting element on the plurality of fuel injectors.

* * * * *